United States Patent [19]

Trexler, Sr.

[11] 4,178,908

[45] Dec. 18, 1979

[54] FIREPLACE HEATING UNIT

[76] Inventor: Charles H. Trexler, Sr., 6229 Debora Dr., Richmond, Va. 23225

[21] Appl. No.: 948,785

[22] Filed: Oct. 5, 1978

[51] Int. Cl.[2] ..... F24B 7/00

[52] U.S. Cl. ..... 126/121; 126/134; 126/126

[58] Field of Search ..... 126/121, 129, 131, 123, 126/154, 164, 167, 168, 134, 135, 137

[56] References Cited

U.S. PATENT DOCUMENTS

| | | | |
|---|---|---|---|
| 1,008,170 | 11/1911 | Massey | 126/164 |
| 2,183,458 | 12/1939 | Lathrop | 126/134 |
| 3,958,755 | 5/1976 | Cleer, Jr. | 137/1 A |
| 4,004,731 | 1/1977 | Zung | 126/121 |
| 4,004,731 | 1/1977 | Zung | 126/271 |
| 4,015,581 | 4/1977 | Martenson | 126/121 |
| 4,019,492 | 4/1977 | Rush | 126/121 |
| 4,026,263 | 5/1977 | Boyd | 126/121 |
| 4,026,263 | 5/1977 | Boyd | 126/135 X |
| 4,061,189 | 12/1977 | Moncrieff-Yeates | 126/121 |
| 4,076,011 | 2/1978 | Proulx | 126/121 |
| 4,131,105 | 12/1978 | Moncrieff-Yeates | 126/131 X |

*Primary Examiner*—Carroll B. Dority, Jr.
*Assistant Examiner*—Larry Jones
*Attorney, Agent, or Firm*—Strauch, Nolan, Neale, Nies & Kurz

[57] ABSTRACT

A novel forced air fireplace heating unit in which a plenum for delivering heated air to a room or other space overlies a double jacketed furnace and communicates with an air heating space between the furnace's jackets, whereby air introduced into the heating space by convection or by a blower flows through the heating space and then through the plenum for delivery to the area to be heated.

17 Claims, 10 Drawing Figures

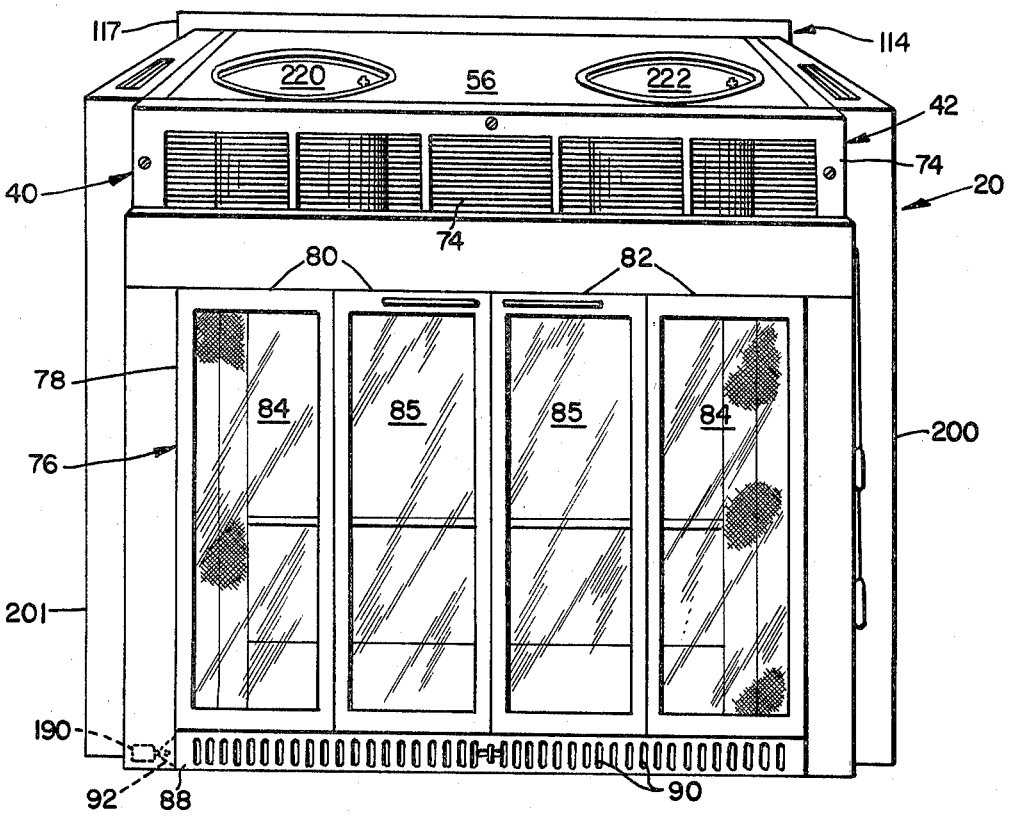
FIG. 1
FIG. 2
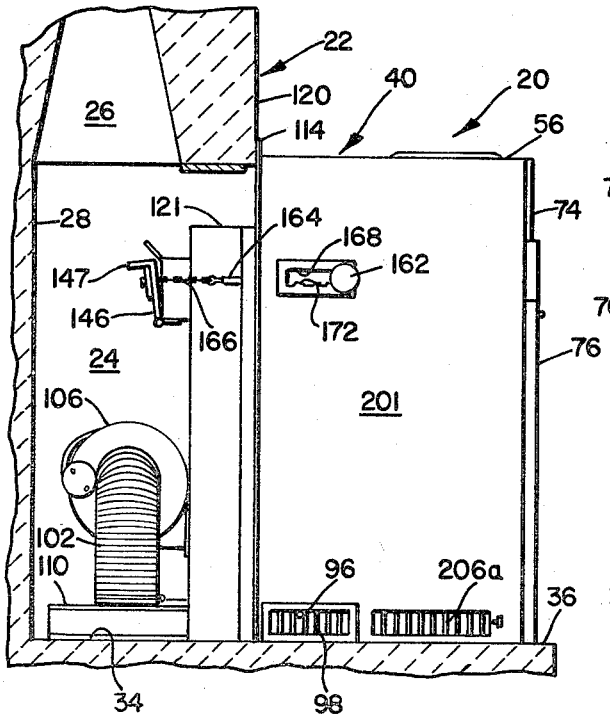
FIG. 3
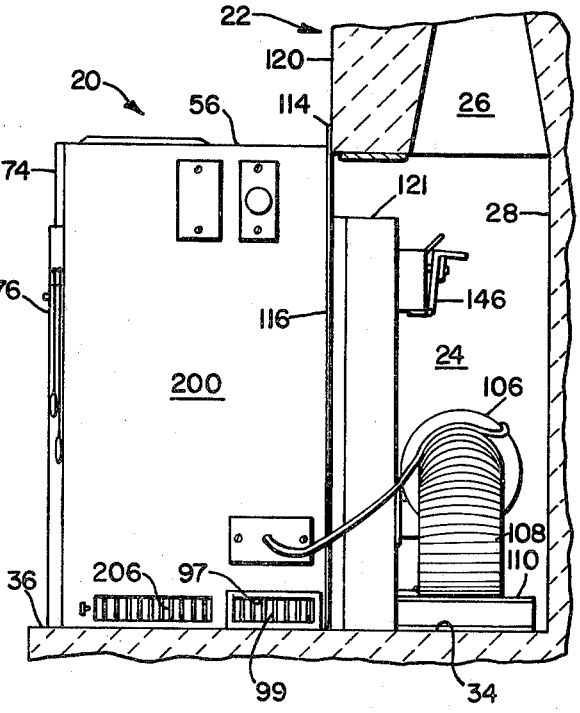

FIREPLACE HEATING UNIT

FIELD OF INVENTION

This invention relates to fireplace heating systems and is particularly concerned with a novel, self-contained fireplace heating unit which is adapted for placement in an existing fireplace or some other location for heating a room or other confined space.

BACKGROUND

Prior to this invention various types of air heating units have been proposed for fireplaces. Some, such as the one shown in U.S. Pat. No. 4,062,344, are of relatively complicated construction and are not suitable for installation in an existing fireplace.

Others are of simplified construction and are adapted for placement in an existing fireplace recess without requiring modification to the fireplace structure. The simpler heating units, which can be placed on the floor of the fireplace, usually have a row or bank of log-supporting tubes and an electrically powered blower which forces air through the tubes by way of a manifold. The tubes are curved to pass above the fire so that the air is heated as it flows through the tubes. This type of forced air heating unit, while being relatively inexpensive, has several drawbacks.

For example, the air tubes are subject to heat damage if the electric power for operating the forced air blower is cut off for a significant length of time. Furthermore, this type of heating unit is usually designed to burn logs or the like and not other fuels such as stove coal. Still further, the burning of the fuel is no more efficient than it would be in the fireplace itself.

The present invention has none of the drawbacks mentioned above, but retains the advantageous feature of being easily installable in an existing fireplace as well as offering additional advantages as will become apparent from the following summary and detailed description.

SUMMARY AND OBJECTS OF INVENTION

The fireplace heating unit of this invention is self-contained and free-standing in that it is completely preassembled for placement on the fireplace floor surface and requires no modification to the fireplace structure other than the possible removal of the fireplace butterfly damper.

In the fireplace air heating unit of this invention a plenum for delivering heated air to a room or other space overlies a furnace to provide an efficiently organized, compact arrangement. The furnace preferably is a double jacketed construction having inner and outer jackets or shells. An air conduction or air heating space formed between the inner and outer jackets is sealed from the combustion chamber in the furnace to keep the flue gases separated from the fresh or ambient air that is used as the heating medium. The furnace's air heating space communicates with the overlying plenum by way of a bank of air-conveying tubes extending through the upper portion of the combustion chamber.

Air to be heated is drawn in through one or more ducts by a forced air blower or fan and is fed by the fan to the furnace's air heating space mentioned above to flow through the air heating space and the bank of air tubes to the overlying plenum for delivery to the room or other space to be heated. The ducts conveying the air to the forced air blower preferably lie on the underside of the furnace to absorb heat from the furnace floor. This arrangement preheats the air travelling to the forced air blower and contributes to the overall efficiently organized compact arrangement of the heating unit.

Preferably, the air heating spaced between the furnace's inner and outer jackets extend along the back, both sides and the bottom of the furnace. Air travelling through this air heating space cools the furnace's outer walls and thus prevents excessive heating of exposed wall surfaces. The air-cooled double-jacketed furnace construction thus affords safety against possible burns due to contact with the exposed metal parts. Extending the air heating space along the bottom of the furnace prevents excessive heating of the floor or support surface on which the heating unit is seated.

The forced air blower mentioned above is advantageously mounted on the back of the heating unit for quiet operation. In this location the blower is out of sight and thus does not mar the appearance of the fireplace.

A firebox and grate assembly is mounted in the combustion chamber to support and confine a solid fuel. The firebox has an open top allowing the hot combustion gases to pass upwardly and around the previously mentioned air conveying tubes and through a manually controllable damper to an existing chimney. Different grate assemblies may be used in the firebox to accomodate an assortment of different solid fuels such as logs, wood scrap, stove coal, corn cobs, trash and other refuse. Since the previously mentioned air-conveying tubes are not used to support the fuel in the combustion chamber they are not subject to heat damage when the blower is turned off.

In addition to being manually operated, the forced air blower may also be temperature controlled to operate automatically.

In the preferred embodiment of this invention the heating unit projects forwardly of the fireplace recess to seat on the hearth in front of the fireplace recess or chamber, and only the rearward portion of the furnace is received in the fireplace recess itself. In the following description and appended claims the brick, stone, or cement area in front of the fireplace and more particularly in front of the fireplace recess is identified as the hearth and the floor surface within the fireplace recess itself is identified as the fireplace floor.

Preferably, the front of the heating unit's furnace is closed by glass doors of conventional construction, thus making the fire within the combustion chamber visible to occupants in the room being heated.

Upwardly opening water-receiving receptacles may optionally be mounted in the top of the heating unit to extend through the plenum which overlies the furnace. Water introduced into these receptacles is heated and vaporized for humidifying the room. These water-filled receptacles may also be used for food warming purposes.

With the foregoing in mind a major object of this invention is to provide a novel forced air fireplace heating unit which is efficient in operation and which can easily be installed in or removed from an existing fireplace.

Another important object of this invention is to provide a novel, efficiently organized fireplace heating unit which is economical to operate.

Still another object of this invention is to provide a novel forced air fireplace heating unit in which a plenum for delivering heated air to a room or other space overlies a double jacketed furnace and communicates with an air heating space between the furnace's jackets, whereby air introduced into the heating space by convection or by a blower flows through the heating space and then through the plenum for delivery to the area to be heated.

A further object of this invention is to provide a novel fireplace air heating unit having a means for humidifying the room or other space being heated.

Still a further object of this invention is to provide a novel forced air fireplace heating unit having a double jacketed furnace to prevent excessive heating of exterior parts.

Yet another object of this invention is to provide a novel forced air fireplace heating unit which is quiet in operation, which provides a closed combustion chamber, and which has glass doors to permit the fire to be viewed by occupants of the room being heated.

Further objects of this invention will appear as the description proceeds in connection with the below-described drawings and the appended claims.

DESCRIPTION OF DRAWINGS

FIG. 1 is a perspective view of a preferred embodiment of the fireplace heating unit incorporating the principles of this invention;

FIG. 2 is a right hand side elevation of the fireplace heating unit shown in FIG. 1 and illustrates the unit positioned in a fireplace;

FIG. 3 is a left hand side elevation of the fireplace heating unit shown in FIG. 1 and illustrates the unit positioned in the fireplace similar to FIG. 2;

DETAILED DESCRIPTION

Figure 4:
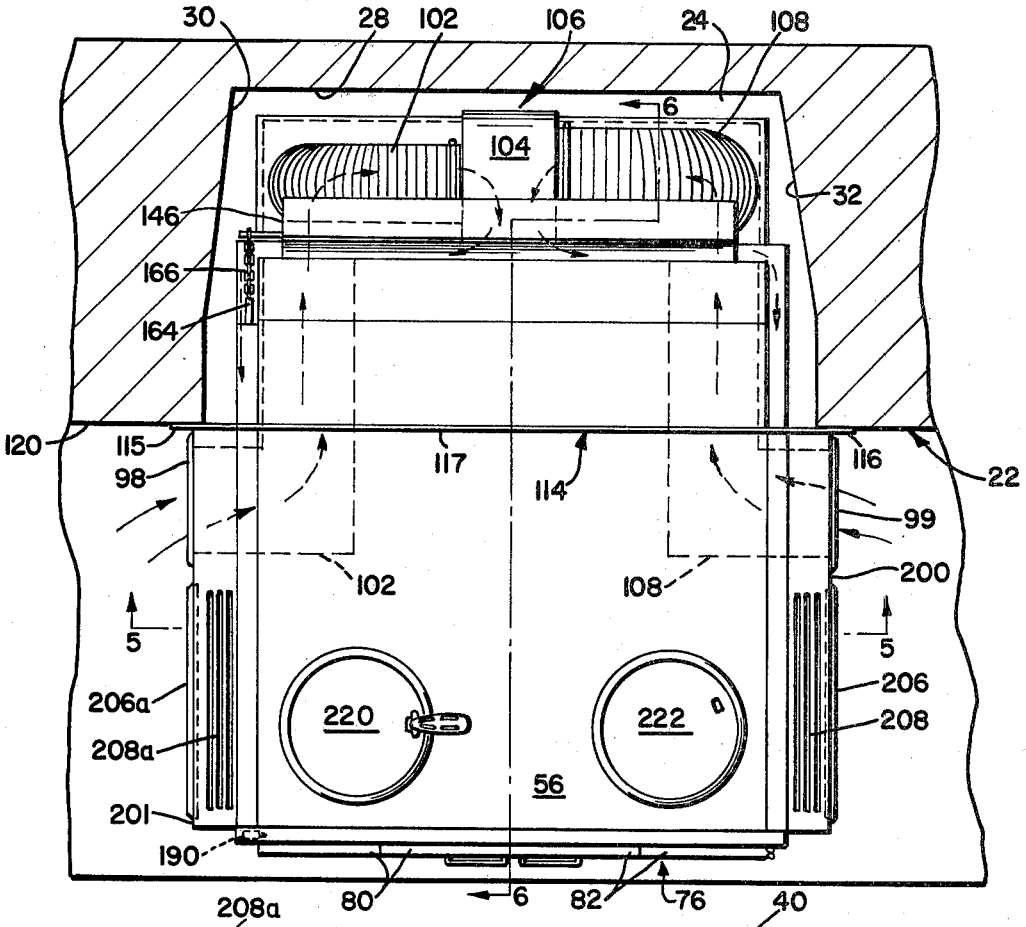
FIG. 4 is a top plan view of the fireplace heating unit shown in FIG. 1 and also illustrates the unit positioned in the existing fireplace.

In FIGS. 1-4, the forced air fireplace heating unit of this invention is generally indicated at 20 and is shown to be installed in an existing fireplace 22 of conventional construction. Fireplace 22 has the usual fireplace recess 24 communicating with a chimney flue 26. Recess 24 is formed by a back wall 28 and side walls 30 and 32. The fireplace floor within recess 24 itself is indicated at 34, and the flat raised hearth or ledge disposed forwardly of the fireplace recess is indicated at 36. The hearth 36 is an extension of and lies in the same plane as the fireplace floor 34.

Figure 5:
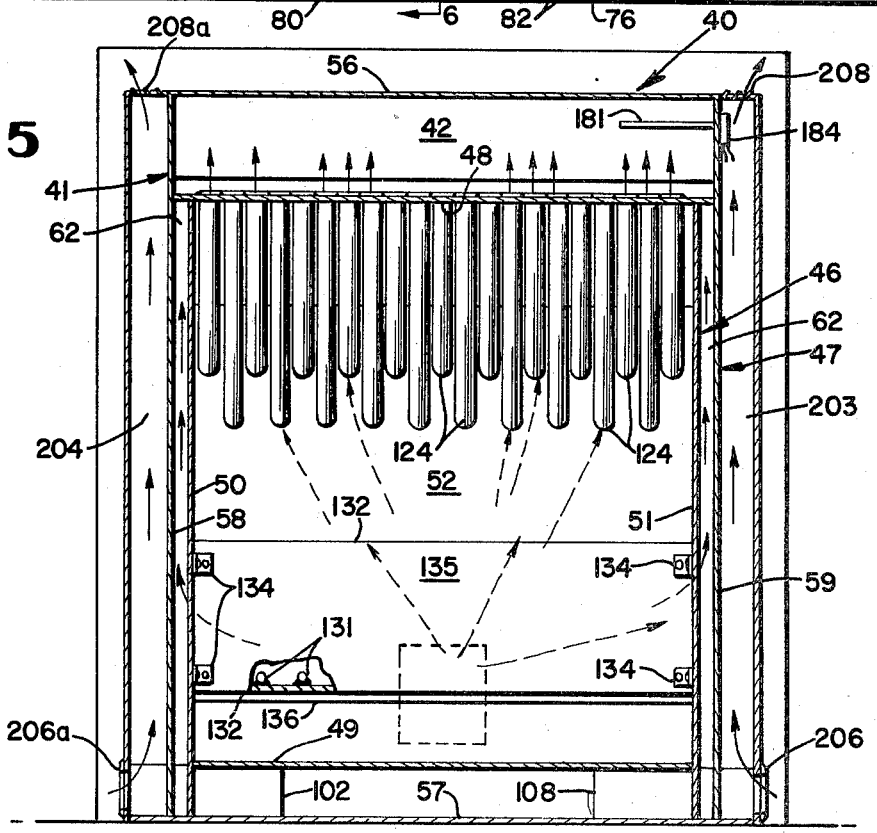
FIG. 5 is a section taken substantially along lines 5—5 of FIG. 4.
Figure 6:
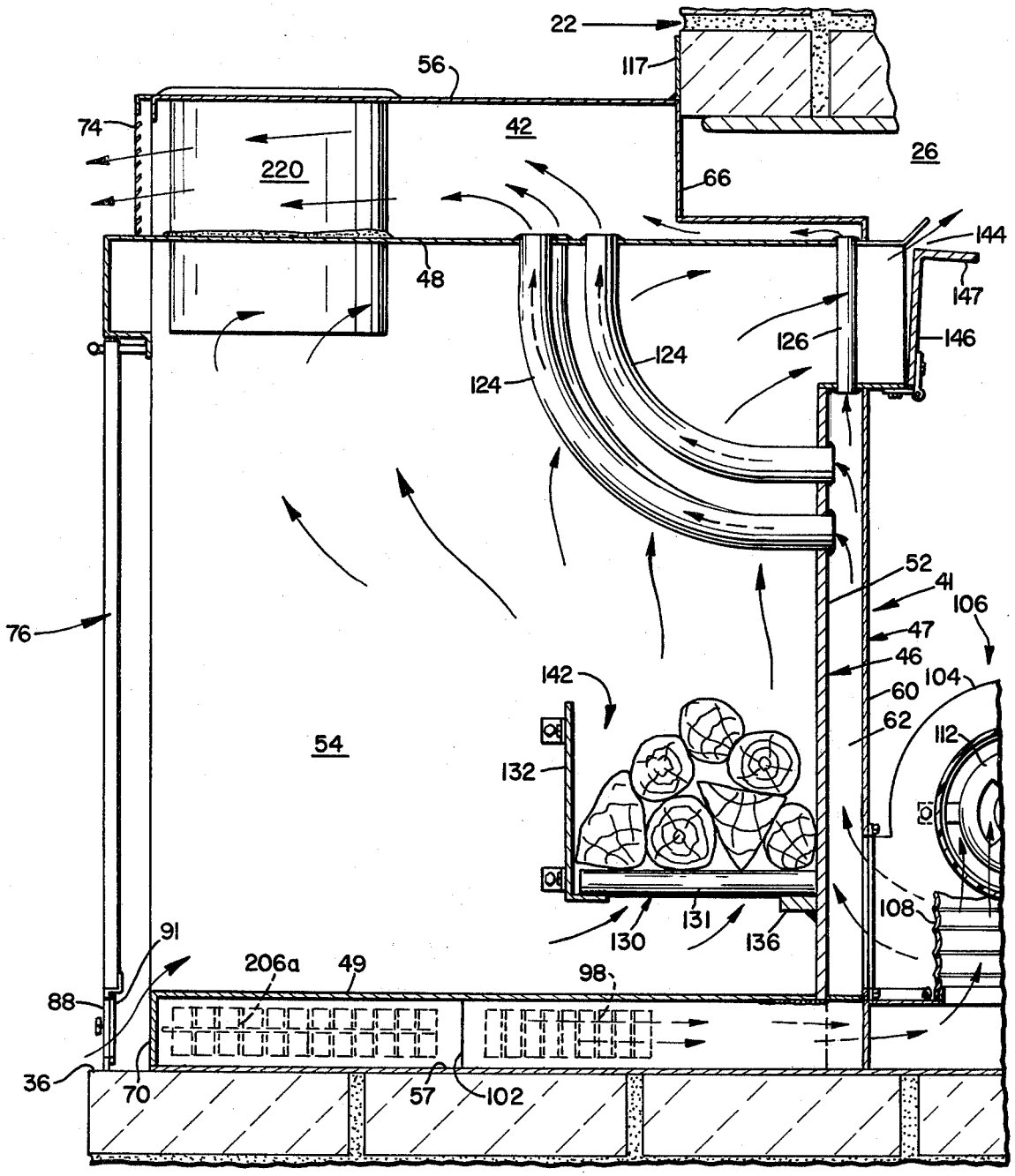
FIG. 6 is a section taken substantially along lines 6—6 of FIG. 4.
Figure 7:
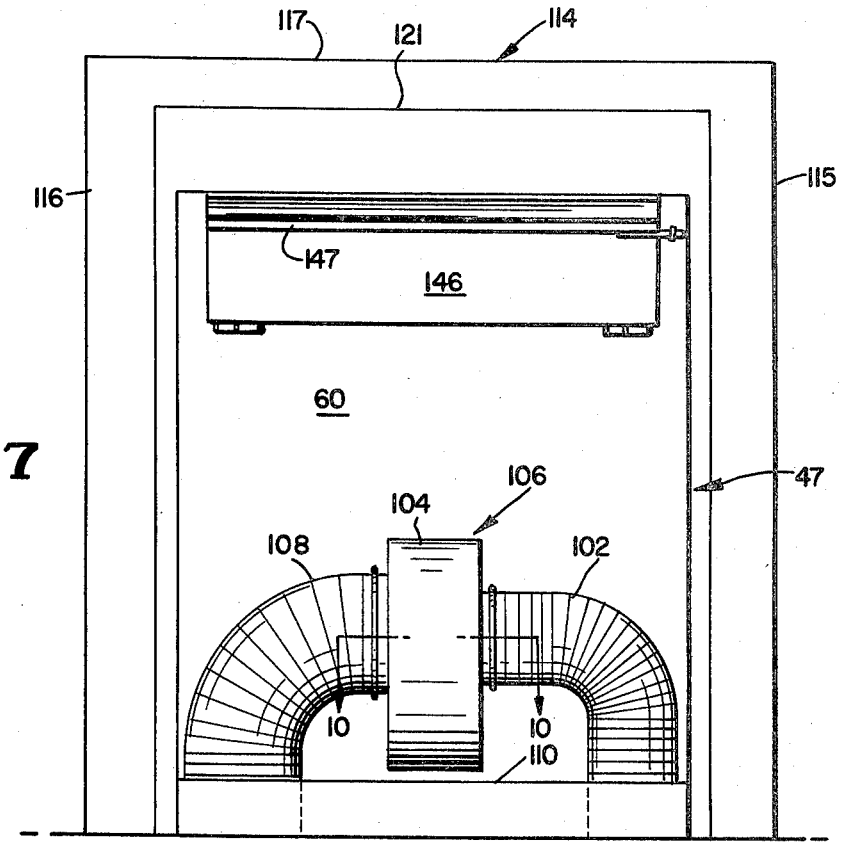
FIG. 7 is a rear elevation of the fireplace heating unit shown in FIG. 1.
Figure 8:
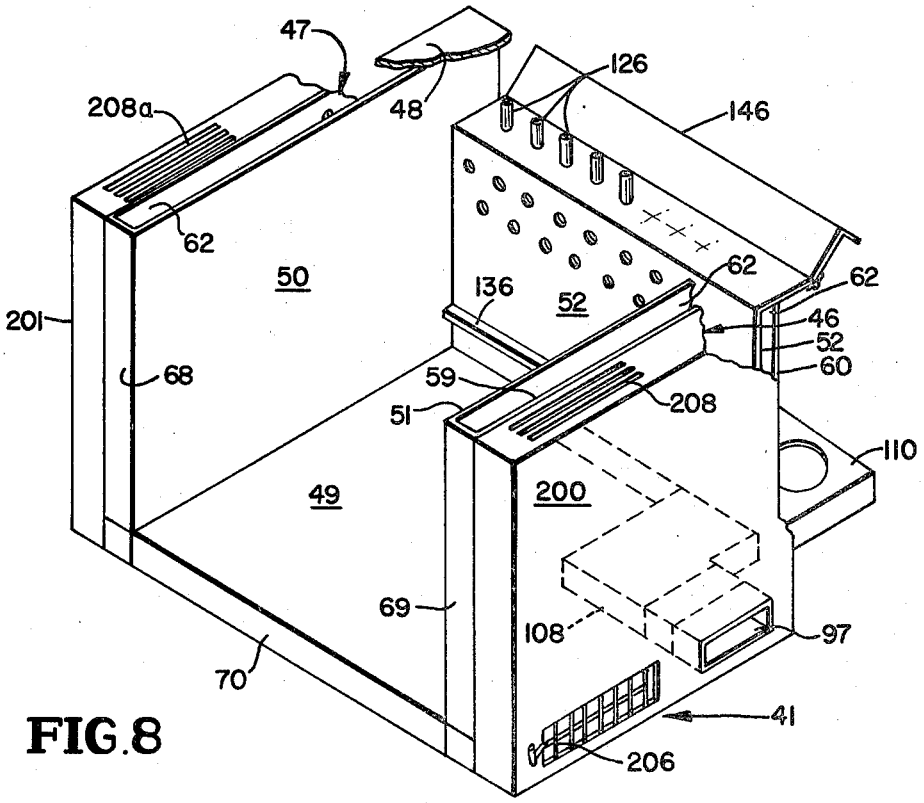
FIG. 8 is a fragmentary perspective view of the heating unit's double jacketed furnace.

As best shown in FIGS. 5, 6 and 8, heating unit 20 comprises a metal housing or jacket structure 40 which defines a double jacketed furnace 41 and a plenum 42 overlying furnace 41. The double jacket of furnace 41 is defined by an inner jacket 46 and an outer jacket 47. Jackets 46 and 47 form a part of housing structure 40.

Jacket 46 is formed with parallel spaced apart top and bottom furnace walls 48 and 49, parallel spaced apart furnace side walls 50 and 51 extending perpendicularly between the top and bottom walls 48 and 49 and a rear furnace wall 52 extending perpendicular to the other walls of jacket 46 as shown. Walls 48-52 delimit the furnace's combustion chamber 54.

Outer jacket 47 is formed with a bottom wall 57, parallel spaced apart side walls 58 and 59 and a rear wall 60. Walls 58-60 extend perpendicularly from bottom wall 57. The overall configuration of each of the jackets 46 and 47 is box shaped.

The inner jacket 46 is rigidly fixed within the outer jacket 47 in such a way that the two side walls, the back wall and the bottom wall of the inner jacket are spaced from and are parallel with the corresponding wall surfaces of the outer jacket. Thus, wall 50 is spaced from and opposes wall 58, wall 51 is spaced from and opposes wall 59, wall 49 is spaced from and opposes wall 57, and wall 52 is spaced from and opposes wall 60.

The arrangement of the inner and outer jackets 46 and 47 is such that a continuous air conduction or air heating space 62 is formed between the opposing inner and outer jacket wall surfaces along the back, the bottom and both sides of the furnace 41. With this construction, it will be appreciated that air space 62 is delimited by walls 50 and 58 along one side of the furnace, by walls 51 and 59 along the other side of the furnace, by walls 52 and 60 along the back side of the furnace, and by walls 49 and 57 along the bottom of the furnace.

As shown, wall 48 extends outwardly to the outer jacket 47 along both sides of furnace 41 to delimit and cover the upper end of air space 62. At the forward end of heating unit 20 air space 62 is closed by wall panels 68, 69 and 70 (see FIG. 8).

The chamber space defined by plenum 42 is enclosed along its top by a top wall 56, along its bottom by wall 48, along its sides by the upper portions of the outer jacket side walls 58 and 59, and along its rear by a wall 66. Plenum 42 spans the entire width of heating unit 20 between the outer jacket side walls 58 and 59 and extends rearwardly from the front of the heating unit to wall 66. Plenum 42 is therefore located vertically above combustion chamber 54 and is separated from chamber 54 only by a single wall, namely the furnace top wall 48.

The forwardly directed end of plenum 42 is covered by a louvered heated air outlet grille 74. Grille 74 spans the space between side walls 58 and 59 and defines the outlet port for delivering air from the plenum 42 to the room or other area being heated.

Below grille 74 the front open end of furnace 41 is closed by a glass door assembly 76 which is mounted in a rectangular frame 78. Frame 78 is suitably fixed to housing structure 40 at the front of the heating unit 20. Door assembly 76 may be of any conventional construction and is shown to be of the typical fireplace glass door construction having two hinged units 80 and 82. Each unit has two tempered glass panels 84 and 85. When the door units 80 and 82 are closed, the glass panels of units 80 and 82 extend across the front of furnace 41 in a common plane to close the opening through frame 78. Panels 84 and 85 are so hinged that units 80 and 82 fold away from each other towards opposite sides of frame 78 to provide access to combustion chamber 54.

An adjustable combustion air inlet register 88 comprises a row of air inlet ports 90 formed through the bottom portion of frame 78 below door assembly 76. Register 88 further includes a slide member 91 (FIG. 6) transversely slidable on the back side of frame 78 to control and adjust the open areas of ports 90. This construction is conventional.

Air in the room or area around heating unit 20 is admitted to combustion chamber 54 by way of register 88. Due to the construction of housing structure 40 and particularly the inner and outer jackets 46 and 47, the combustion air flowing through register 88 will pass only into combustion chamber 54 and will not enter the air space 62 or plenum 42.

Separate air inlet ports, indicated at 96 and 97, are provided to admit air to be heated and to thus keep the air to be heated separate from the combustion air and also from the combustion gases that result from the burning of fuel in combustion chamber 54. Port 96 is formed through the lower portion of a side panel 201 on one side of heating unit 20, and port 97 is formed through the lower portion of a side panel 200 on the opposite side of heating unit 20. As shown, port 96 is covered by a grille 98, and port 97 is covered by a grille 99. Grilles 98 and 99 may be of any suitable construction.

Referring to FIGS. 4, 5 and 8, a metal duct 102 extends between and connects the air inlet port 96 to the rotor housing 104 of a forced air blower 106. Air inlet port 97 is connected to the rotor housing 104 by a separate metal duct 108.

Ducts 102 and 108 extend from their associated air inlet ports 96 and 97 through the portion of the air heating space 62 between walls 49 and 57. Portions of ducts 102 and 108 thus lie on the underside of the furnace bottom wall 49 and may be delimited by the flat underside of the furnace bottom wall. The discharge or outlet end portions of ducts 102 and 108 extend upwardly through a horizontal deck 110 which extends or projects rearwardly from the outer jacket rear wall 60. Deck 110 forms a part of housing structure 40 as shown.

Figure 10:
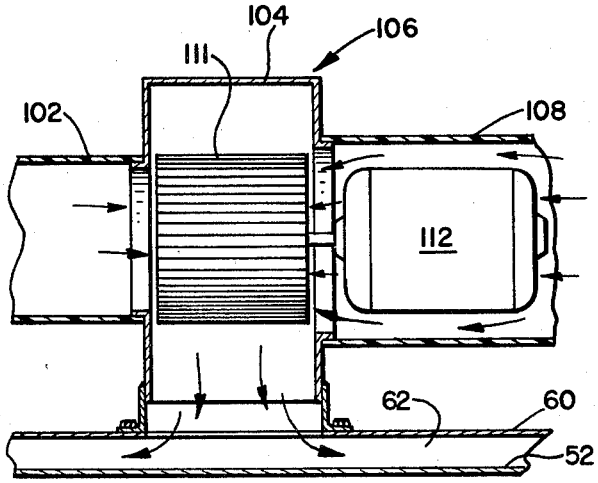
FIG. 10 is a section taken substantially along lines 10—10 of FIG. 7.

As shown in FIG. 10 blower 106 comprises a rotor 111 mounted for rotation in housing 104 and a motor 112 coupled to rotor 111 for driving the rotor. The horizontally extending air outlet end portions of ducts 102 and 108 are axially aligned and are secured to housing 104 on opposite sides thereof so that rotor 111 is effective to draw air in through opposite sides of housing 104 by way of ducts 102 and 108. Motor 112 is coaxially mounted in the horizontally extending outlet end portion of duct 108. The output shaft of motor 112 rotates about an axis aligning with the rotation axis of rotor 111.

The air blower housing 104 is positioned on deck 110 rearwardly of wall 60 at a location where it is medially intersected by a longitudinal plane which also medially intersects furnace 41 and plenum 42. Ducts 102 and 108 may advantageously be arranged symmetrically on opposite sides of this plane.

The air discharge port of housing 104 registers with an opening in the lower portion of the outer jacket's rear wall 60 such that blower 106 forces air into the air space 62 between the inner and outer jackets 46 and 47.

As shown, a rigid three-sided structural flange 114 having two straight side members 115 and 116 and an upper cross member 117 is fixed to the exterior of housing structure 40 and extends outwardly therefrom for seating engagement with the front face 120 of fireplace 22. Side members 115 and 116 extend along the oppositely sides of the heating unit. Cross member 117 extends between and is fixed to side members 115 and 116. Cross member 117 lies in a vertical plane containing side members 115 and 116 and extends upwardly from the rear wall 66 of plenum 42.

As shown in FIGS. 2 and 3, the outer jacket 47 is stepped down in a plane containing flange 114 to provide a rear section 121 of reduced cross section. Section 121 extends rearwardly of flange 114 and has a width and height that is smaller than that of the part of jacket 47 extending forwardly of flange 114.

Heating unit 20 is installed in the existing fireplace simply by sliding it rearwardly along hearth 36 to a position where flange 114 seats against the front face 120 of the fireplace. In this position, the stepped down rear portion 121 of housing structure 40 will be fully received in the fireplace recess 24 as shown in FIGS. 2 and 3. In this operating position of heating unit 20, plenum 42 is disposed forwardly of the fireplace's front wall 120. Likewise, the ambient air inlet ports 96 and 97 are also disposed forwardly of the fireplace's front wall 120 so that operation of blower 106 will draw air in from the room being heated. It also will be noted that blower 106 will be received in the fireplace recess 24 for quiet operation and lies between rear wall 60 and the fireplace wall 28 where it is completely out of sight.

By seating against the fireplace's front face 120, flange 114 limits the extent to which the heating unit is insertable into the fireplace recess 24 and provides a seal extending peripherially around housing structure 40 to block the escape of flue gases that may tend to leak out from the flue area of the fireplace.

As shown in FIGS. 5 and 6, a bank of steel airconveying tubes 124 are mounted in the upper rearward corner of combustion chamber 54 and curve upwardly from the rear furnace wall 52. The inlet ends of tubes 124 are fixed in wall 52 and open into the portion of air space 62 which lies between walls 52 and 60. The outlet ends of tubes 124 are fixed in the furnace's top wall 48 and open upwardly into the chamber space defined by plenum 42.

Tubes 124 may be arranged in spaced apart relation in two groups having different radii of curvature. The tubes having the greater curvature are staggered with respect to the tubes having the smaller curvature.

A separate row of straight tubes 126 are arranged behind the two rows of curved tubes 124 and extend upwardly through the upper rear region of combustion chamber 54. Tubes 124 and 126 interconnect and provide fluid communication between air space 62 and plenum 42 to convey air from air space 62 to plenum 42.

The arrangement of the two groups of tubes 124 and 126 is such that the hot combustion gases generated by burning of fuel in combustion chamber 54 will follow sinuous paths around the tubes to provide for an efficient transfer of heat from the combustion gases to the air flowing through the tubes.

Tubes 124 and 126 provide the only paths by which air can flow into plenum 42 from air space 62. Furthermore, the construction of heating unit 20 is such that air can only enter the air space 62 by way of the blower housing 104. In the illustrated embodiment air can only enter the blower housing by way of ducts 102 and 108. The ambient air drawn in by blower 106 is therefore kept separate from the combustion gases that are produced by burning fuel in combustion chamber 54.

Referring to FIGS. 5 and 6, a metal, fuel-supporting grate structure 130 is disposed in the lower rearward portion of combustion chamber 54. Grate structure 130 may be of any suitable construction and is shown to comprise an array of spaced apart metal bars 131 which are fixed to or supported on the horizontally extending leg of structural member 132.

Member 132 is removably secured to the furnace side walls 50 and 51 by bolt and clip assemblies 134 at a level raised above the floor of furnace 41. As shown, member 132 is provided with a fuel-confining vertical front wall 135 which extends upwardly from grate structure 130. Front wall 135, regions of the furnace side walls 50 and 51 and the furnace rear wall 52 define an upwardly opening firebox or receptacle 152 for confining wood or other solid fuel to be burned on grate structure 130. The metal bars 131 extend rearwardly from the front wall 135 and are seated at their rearward ends on a ledge which is formed by a structural member 136. Member 136 is rigidly fixed to the furnace rear wall 52.

Member 132 and grate structure 130 are removable as a unit and may be replaced by another front wall member together with a different grate structure (not shown) for supporting other types of fuel such as stove coal. For example a shaker grate may be used in place of the one shown.

As shown, grate structure 130 is supported at a level that is spaced above the furnace's bottom wall or floor 49. Ashes drop through grate structure 130 onto floor 49 to heat floor 49.

Tubes 124 are disposed vertically above the fuel-containing firebox 142 and are arranged in transversely extending rows which lie between the fire and a rectangular flue gas outlet opening 144. Outlet 144 is formed through housing structure 40 and opens into the chimney flue 26. Hot combustion gases produced by burning fuel in firebox 142 are drawn by the chimney draft upwardly around tubes 124 and through the outlet opening 144 into the chimney for the existing fireplace. A damper 146 is pivotally mounted at the outlet opening 144 and is manually adjustable to vary the effective fluid passage area through outlet 144.

From the construction thus far described it will be appreciated that ambient air from the room being heated is drawn in through ducts 102 and 108 by the operation of blower 106 and is forced by blower 106 to circulate through air space 62. From air space 62 the air is forced to flow through tubes 124 and is therefore heated by the hot combustion gases produced by the fire in combustion chamber 54. The air will also be heated as it is circulated through the air space 62 by the heat conducted through the furnace walls. Heated air is therefore conveyed into plenum 42 and is then delivered through grille 74 into the room or surrounding area being heated.

Additionally, the air in plenum 42 will be heated by the heat conducted through the furnace top wall 48. Furthermore, the air travelling through ducts 102 and 108 will be preheated by the heat conducted through the furnace bottom wall 49. Thus, a significant transfer of heat will take place as the air flows through ducts 102 and 108, air space 62, tubes 124 and plenum 42.

The ambient air drawn through duct 108 passes over motor 112 to cool the motor during operation. The forced air circulated through air space 62 prevents excessive heating of the exterior metal housing surfaces of heating unit 20.

Any suitable means may be provided for manually adjusting damper 146. In the illustrated embodiment the adjustment is accomplished by a handle or knob 162 (FIG. 2) which is mechanically linked to damper 146 by a rod 164 and a chain 166.

Knob 162 is fixed to rod 164 and projects laterally through a slot 168 in side panel 201 for selective movement along slot 168. Rod 164 is slidably supported for longitudinal movement in an unshown guideway, and chain 166 connects the rearward end of rod 164 to damper 146.

Damper 146 is pivotable at its lower edges to swing between a wide open position and a closed position. In its closed portion damper 146 will be slightly rearwardly inclined from a vertical plane in a position where it does not completely block passage of flue gases through outlet 144. In this position damper 146 will maintain chain 166 in tension and is weighted by a rearwardly extending flange 147 so that it tends to pivot to its full open position by its own weight.

The pivotal movement of the damper 146 towards its open position is restrained by seating handle 162 in a selected one of a plurality of notches 172. Notches 172 are formed in the lower upwardly facing edge of slot 168. Suitable spring biasing means (not shown) may be used for biasing handle 162 into an aligned one of notches 172. In order to adjust damper 146 handle 162 is lifted slightly against the spring bias to raise it above the notch in which it is seated. The handle is then shifted in one direction or the other to align it with a different notch and is then released so that it seats in the aligning notch, thus holding the damper in its adjusted position. Movement of handle 162 along slot 168 longitudinally shifts rod 164 to pivot damper 146.

In the illustrated embodiment the blower motor 112 may be of a conventional variable speed type having a variable speed controller 180 (FIG. 9) which is selectively operable by rotation of a knob 182 (FIG. 3). Operation of knob 182 turns motor 112 on and off and varies the motor speed similar to the operation of a dimmer switch.

Figure 9:
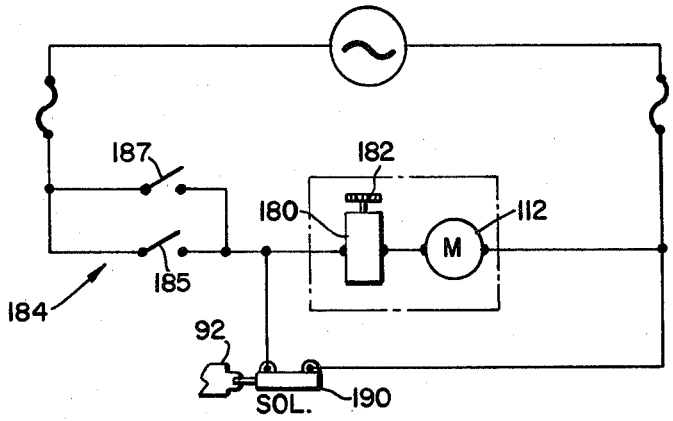
FIG. 9 is a schematic electrical circuit diagram of the automatic temperature control for the fireplace heating unit.

As shown in FIG. 9, current for operating motor 112 is fed to controller 180 by way of a limit switch 185 in a conventional air stat 184 or other form of thermostatic switch device. Air stat 184 has a temperature sensing element 181 extending into plenum 42 to sense the temperature of the heated air in plenum 42.

Air stat 184 is set so that limit switch 185 will close only when the air in plenum 42 rises to some preselected temperature. For example switch 185 may be set to close when the temperature of the air in plenum 42 rises to about 120° F.

When limit switch 185 closes then the circuit will be completed to the variably speed motor controller 180 which is manually set to drive the motor at a preselected speed.

A manually operated switch 187 may optionally be connected in parallel with switch 185 as shown in FIG. 9. Closure of switch 187 bypasses switch 185 to energize motor 112 when switch 185 is open.

As an optional feature solenoid 190 may be connected in series with the limit switch 185 as shown in FIG. 9. The spring biased armature of solenoid 190 is mechanically linked to the control slide 92 of register 88. Slide 92 is normally open at start up so that it provides the maximum air passage area through register 88 to furnish a maximum supply of combustion air to combustion chamber 54. When the temperature of air in plenum 42 reaches the value that closes switch 185 solenoid 192 will be energized to shift slide 192 to a position where it reduces the amount of combustion air being delivered to combustion chamber 54.

If a power failure occurs or if for some other reason the electric power for operating motor 112 is cut off, air will continue to flow by convection through ducts 102 and 108, air space 62, and plenum 42 to the room being heated.

In the illustrated embodiment the exterior side panels 200 and 201 are mounted on opposite sides of housing structure 40. Panel 200 cooperates with the housing side wall 59 to define an air channel 203. Panel 201 similarly cooperates with the housing side wall 58 to define an air channel 204. The electrical wiring, including the temperature control and the motor controller, is installed in air channel 203. Channel 203 is closed except for an air inlet register 206 near the bottom edge of panel 200 and an air outlet grille 208 in a top wall portion 210 of panel 200.

Room temperature air from the area being heated passes through register 206 into channel 203 where it is heated by the heat conducted through the side walls of housing structure 40. The heated air in channel 203 will therefore flow upwardly by convection to pass out through grille 208. This flow of air through channel 203 keeps the electrical wiring in the channel cool to thereby prevent damage due to overheating. Additionally, the outer side wall of panel 200 will be cooled by the flow of air through channel 203.

Side panel 201 may be of the same construction as panel 200 and has an air inlet register **206*a* and an air outlet grille 208*a*. Register 206*a* and grille 208*a* are located in a manner similar to register 206 and grills 208. Panel 201 operates in the same way as panel 200 to provide for the flow of room air by convection through channel 204 thus keeping the outer side wall of panel 201** cool.

In the illustrated embodiment a pair of upstanding, metal, water-receiving pots or receptacles 220 and 222 are mounted in the top of housing structure 40. Each of the receptacles 220 and 222 opens upwardly and extends through aligned aperatures in walls 56 and 48 to pass through the chamber space defined by plenum 42 and into the upper region of combustion chamber 54. The closed bottoms of receptacles 220 and 222 are disposed in combustion chamber 54 as shown. The open ends of receptacles 220 and 222 lie in the plane of top wall 56 so that both receptacles open upwardly into the room or area around heating unit 20.

Water introduced into receptacles 220 and 222 is heated and vaporized by the fire in combustion chamber 54 to humidify the room or other area being heated. Suitable covers may be positioned over the open tops of receptacles 220 and 222 to support cooking pans or the like. The heated air discharged from plenum 42 may be used for hair and clothes drying purposes.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A fireplace heating unit adapted to be supported on the hearth and fireplace floor of an existing fireplace to extend into the existing fireplace recess, comprising a housing structure having (a) a metal furnace jacket defining a combustion chamber for receiving a fuel to be burned and (b) metal housing means receiving said jacket, said housing means and said furnace jacket having spaced apart wall portions to provide an interior air space between said furnace jacket and said housing means, wall means forming a part of said housing structure and partitioning said interior space into a plenum and an air conduction space, said plenum overlying said furnace jacket and combustion chamber, and said air conduction space extending at least along the back of the furnace jacket, conduit means exposed in said combustion chamber and establishing fluid communication between said air conduction space and said plenum to provide for the flow of air from said conduction space to said plenum without mixing with combustion gases in said combustion chamber, a forced air blower connected to feed air to be heated to said air conduction space for flow through said air conduction space and said conduit means to said plenum, the air flowing through said air conduction space and said conduit means being heated by the fire produced by the burning of fuel in said combustion chamber whereby heated air is delivered to said plenum, said plenum having an air outlet opening to provide for the passage of the heated air from said plenum to the room area being heated, said housing structure being adapted to seat on the fireplace floor and said hearth at a location where only a rearward portion of said housing structure is received in said fireplace recess, at least a portion of said plenum and a portion of the combustion chamber vertically underlying said plenum being disposed forwardly of said rearward portion to be positioned forwardly of said fireplace recess when said rearward portion is received in said recess, and at least one upwardly opening water-receiving receptacle mounted in housing structure, said receptacle having its open upper end disposed at the top wall of said plenum at a location where it is disposed forwardly of said fireplace recess to open into the room area being heated, said receptacle extending at least in said plenum and being exposed to the heat produced by burning fuel in said combustion chamber to provide for the vaporization of water in said receptacle.

2. A fireplace heating unit adapted to be supported on the hearth and fireplace floor of an existing fireplace to extend into the existing fireplace recess, comprising a housing structure having (a) a metal furnace jacket defining a combustion chamber for receiving a fuel to be burned and (b) metal housing means receiving said jacket, said housing means and said furnace jacket having spaced apart wall portions to provide an interior air space between said furnace jacket and said housing means, wall means forming a part of said housing structure and partitioning said interior space into a plenum and an air conduction space, said plenum overlying said furnace jacket and combustion chamber, and said air conduction space extending at least along the back of the furnace jacket, said housing structure further defining a combustion gas outlet at a rearward region of said combustion chamber to provide for the exhaust of hot combustion gases from said combustion chamber, an array of air conveying tubes exposed in said combustion chamber and establishing fluid communication between said air conduction space and said plenum to provide for the flow of air from said conduction space to said plenum without mixing with combustion gases in said combustion chamber, said tubes being disposed in a region lying between said combustion gas outlet and the fuel in said combustion chamber such that the hot combustion gases pass around said tubes before exiting through said combustion gas outlet, said tubes providing the only fluid communication between said plenum and said air conduction space, and a forced air blower connected to feed air to be heated to said air conduction space for flow through said air conduction space and said tubes to said plenum, the air flowing through said air conduction space and said tubes being heated by the fire produced by the burning of fuel in said combustion chamber whereby heated air is delivered to said plenum, and said plenum having an air outlet opening to provide for the passage of the heated air from said plenum to the room area being heated.

3. The fireplace heating unit defined in claim 2 wherein said furnace jacket has a top wall portion that separates said combustion chamber from the chamber space defined by said plenum and defines the bottom of said plenum to delimit both said combustion chamber and said chamber space.

4. The fireplace heating unit defined in claim 3 wherein said air conduction space extends at least between a back wall of said furnace jacket and an opposing wall of said housing means, a set of said tubes extending from said back wall to said top wall.

5. The fireplace heating unit defined in claim 4 comprising grate means disposed in said combustion chamber for supporting a solid fuel to be burned, said combustion gas outlet being formed through said furnace jacket and opening rearwardly to provide for the passage of combustion gases from said combustion chamber to the flue of said existing fireplace, said tubes being disposed between said grate means and said combustion gas outlet.

6. The fireplace heating unit defined in claim 2 wherein said furnace jacket has a bottom wall defining the floor of said combustion chamber, wherein said housing structure has at least one air inlet port opening into said room area, and wherein a duct connects said inlet port to said blower to convey the air to be heated to said blower, a portion of said duct lying in a space on the underside of said combustion chamber floor to enable heat conducted through the combustion chamber floor to preheat the air as it flows through said duct.

7. The fireplace heating unit defined in claim 6 wherein said blower comprises a rotor-driving motor mounted in an end portion of said duct.

8. The fireplace heating unit defined in claim 2 wherein the front of said combustion chamber is closed by framed glass doors.

9. The fireplace heating unit defined in claim 2 comprising means responsive to the temperature of the air in said plenum for controlling operation of said blower.

10. The fireplace heating unit defined in claim 2 comprising means for sensing the temperature of the air in said plenum and means controlled by said sensing means for turning on said blower only when the air temperature in said plenum rises to a pre-selected value.

11. The fireplace heating unit defined in claim 2 including an upstanding wall member removably secured to said jacket within said combustion chamber, said upstanding wall member being spaced forwardly of the back wall of said jacket and extending transversely of said combustion chamber, a removable grate structure positioned between said wall member and said back wall of said jacket for supporting a solid fuel to be burned, the fuel on said grate means being confined between said wall member and said back wall.

12. The fireplace heating unit defined in any one of the preceding claims 2 and 3–6 wherein said housing structure has a rearward portion adapted to be received in said fireplace recess, wherein said housing means has a rear wall delimiting said air conduction space, and wherein said blower is mounted on said housing structure rearwardly of said rear wall of said housing means to lie in said fireplace recess when said rearward portion of said housing structure is received in said recess.

13. The fireplace heating unit defined in any one of the preceding claims 2 and 3–6 wherein only a rearward portion of said housing structure is adapted to be received in said fireplace recess, at least a substantial portion of said plenum and the portion of said combustion chamber vertically underlying said substantial portion of said plenum extending forwardly of said fireplace recess when said rearward portion of said housing structure is received in said recess.

14. The fireplace heating unit defined in any one of the claims 2 and 3–6 wherein said housing structure is adapted to seat on said fireplace floor and said hearth and has a rearward portion adapted to be received in said fireplace recess, and wherein positioning means is exteriorly positioned on said housing structure rearwardly of the front of said housing structure for abutment with the front, forwardly directed exterior vertical face of said fireplace such that at least a substantial portion of said plenum and the portion of said combustion chamber vertically underlying said substantial portion of said plenum is disposed forwardly of said fireplace recess when said positioning means is brought into abutment with said exterior vertical face of said fireplace.

15. The fireplace heating unit defined in claim 2 wherein said housing structure is adapted to seat on the fireplace floor and said hearth at a location where only a rearward portion of said housing structure is received in said fireplace recess, at least a portion of said plenum and a portion of the combustion chamber vertically underlying said plenum being disposed forwardly of said rearward portion to be disposed forwardly of said fireplace recess when said rearward portion is received in said recess, and wherein at least one upwardly opening water-receiving receptacle is mounted in housing structure, said receptacle having its open end disposed at the top wall of said plenum and extending through said plenum into said combustion chamber such that the heat produced by burning fuel in said combustion chamber vaporizes water introduced into said receptacle.

16. The fireplace heating unit defined in claim 2 wherein said air conduction space is delimited by said furnace jacket and said housing means to extend along the back, both sides and the bottom of said jacket.

17. The fireplace heating unit defined in claim 2 wherein said housing structure is adapted to seat on the fireplace floor and said hearth at a location where only a rearward portion of said housing structure is received in said fireplace recess, said housing structure further including at least one side panel disposed exteriorly of said housing means and positioned forwardly of said rearward portion to be located forwardly of said recess when said rearward portion is received in said recess, said side panel cooperating with a side wall of said housing means to define an air flow channel having upper and lower apertures to enable air to enter through said lower aperture and to flow by convection upwardly through said channel for discharge through said upper aperture, said blower having an electric drive motor, and electrical wiring disposed in said channel for supplying current to and controlling operation of said motor.

* * * * *